United States Patent [19]

Protta et al.

[11] 3,962,861

[45] June 15, 1976

[54] APPARATUS FOR DETERMINING AND LASTINGLY SHOWING THE TIME AT WHICH AN EVENT OCCURS

[75] Inventors: Jean-Claude Protta, Onex; Antoine Savary, Chatelaine, both of Switzerland

[73] Assignee: Societe Suisse pour l'Industrie Horlogere Management Services S.A., Bienne, Switzerland

[22] Filed: June 7, 1974

[21] Appl. No.: 477,277

Related U.S. Application Data

[63] Continuation-in-part of Ser. No. 320,675, Jan. 2, 1973, abandoned.

[52] U.S. Cl. ..... 58/39.5; 58/4 A

[51] Int. Cl.[2] ..... G04F 10/04; G04B 19/24

[58] Field of Search ..... 58/39.5, 4 A, 150 R, 58/85.5

[56] References Cited

UNITED STATES PATENTS

| | | | |
|---|---|---|---|
| 3,686,880 | 8/1972 | Samejima | 58/39.5 |
| 3,707,071 | 12/1972 | Walton | 58/50 R |
| 3,733,810 | 5/1973 | Girard | 58/4 A |

*Primary Examiner*—Edith Simmons Jackmon
*Attorney, Agent, or Firm*—Silverman & Cass, Ltd.

[57] ABSTRACT

A device for determining and temporarily recording the time of occurrence of an event in which a time-counter is connected to a memory and to a time-indicator. The time-indicator, time-counter and memory are connected through activator means such that when the activator means are activated, the time-indicator will indicate the time when the connection has become effective.

9 Claims, 14 Drawing Figures

COUNTING UNIT AND DECODING SYSTEM
RELEASE KNOB
116
117
115
OR
44
BUFFER STORAGE MEMORY
39
45
40
OR
41
MEMORY DISCH.
42
32
OSCILLATOR DIVIDER
OR
35
34
COMMUTAT'G CIRCUIT
33a
1/10
33b
1/6
33c
1/10
33d
1/6
33e
1/24
33
37a
DECODER
37b
DECOD'R
37c
DECOD'R
37d
DECOD'R
37e
DECOD'R
37
36
SECONDS
MINUTES
HOURS
43
38
113
LOGICAL POWER SUPPLY
ACTUATING MEANS

COUNTING UNIT AND DECODING SYSTEM
BUFFER STORAGE- MEMORY
39
44
45
OR
40
OR
35
COMMUTAT'G. CIRCUIT
34
MEMORY DISCH.
41
OSCILLATOR DIVIDER
32
TEMPORARY MEMORY DISCHARGE INTERRUPTER
42
141
1/10
33a
1/6
33b
1/10
33c
1/6
33d
1/24
33e
33
DECODER
37a
DECOD'R
37b
DECOD'R
37c
DECOD'R
37d
DECOD'R
37e
37
SECONDS
MINUTES
HOURS
36
43
38
ACTUATING MEANS

APPARATUS FOR DETERMINING AND LASTINGLY SHOWING THE TIME AT WHICH AN EVENT OCCURS

This application is a continuation in part application of parent application Ser. No. 320,675 filed Jan. 2, 1973 which is now abandoned.

BACKGROUND OF THE INVENTION

The present invention relates to apparatus for determining and temporarily recording the time of occurence of an event.

DESCRIPTION OF THE PRIOR ART

The conventional devices for measuring time, e.g. watches or clocks, can only provide an accurate indication of the time at which a given event or phenomenon occurs if the occurrence of said phenomenon can be observed simultaneously with the time reading which is visible on the measuring device. When the passage of a moving object is involved, it is often difficult, while watching the displacement of the object, to read on a watch the time at which the object will reach a given spot. It should be well understood that the desired indication of time does not refer to the measure of a time interval but to the recording of an absolute time value with reference to a standard time system, GMT for instance.

U.S. Pat. No. 3,686,880 discloses a regular stop-watch for measuring time intervals, operating electronically.

The stop-watch only permits measuring time intervals with no reference to the hour of the day. This is mostly clearly evident from the fact that the counter has been designed for counting up to 10 hours only.

Also the counter of the stop-watch starts to count only when making a time interval measurement while the apparatus of the present invention counts continuously either by means of the counter itself or by means of a buffer storage memory, depending on the embodiment used.

Furthermore, the stop-watch can only be reset to zero, so that it is ready for another time interval count, while the reset means of the instant invention is designed for resetting in accord with the time flowing. Said reset means comprise a device for temporarily speeding up the counting or stopping it at will for resetting purposes.

Summing up, the stop-watch in U.S. Pat. No. 3,686,880 does not have an arrangement for having the time indicator provide the absolute time when a connection between the counter and the indicator has become effective.

SUMMARY OF THE INVENTION

Apparatus for determining the time of an event comprising a time-counter connected to a memory and a time-indicator and means for providing an active connection between the counter and the memory, as well as between the counter and the time-indicator, such that when said connection with the memory is actuated, the time-indicator indicates the time when said connection has become effective.

DESCRIPTION OF THE PREFERRED EMBODIMENTS

Figure 1:
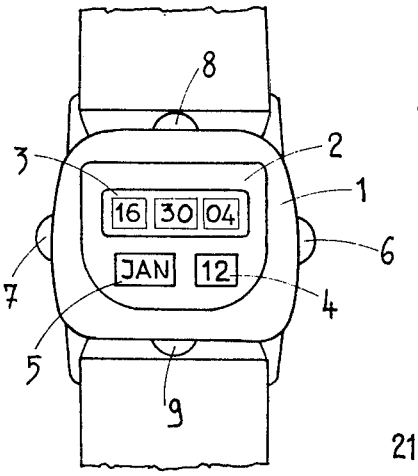
FIG. 1 illustrates an apparatus for determining and showing the time of occurrence of an event in the form of a wrist-watch.
Figure 2:
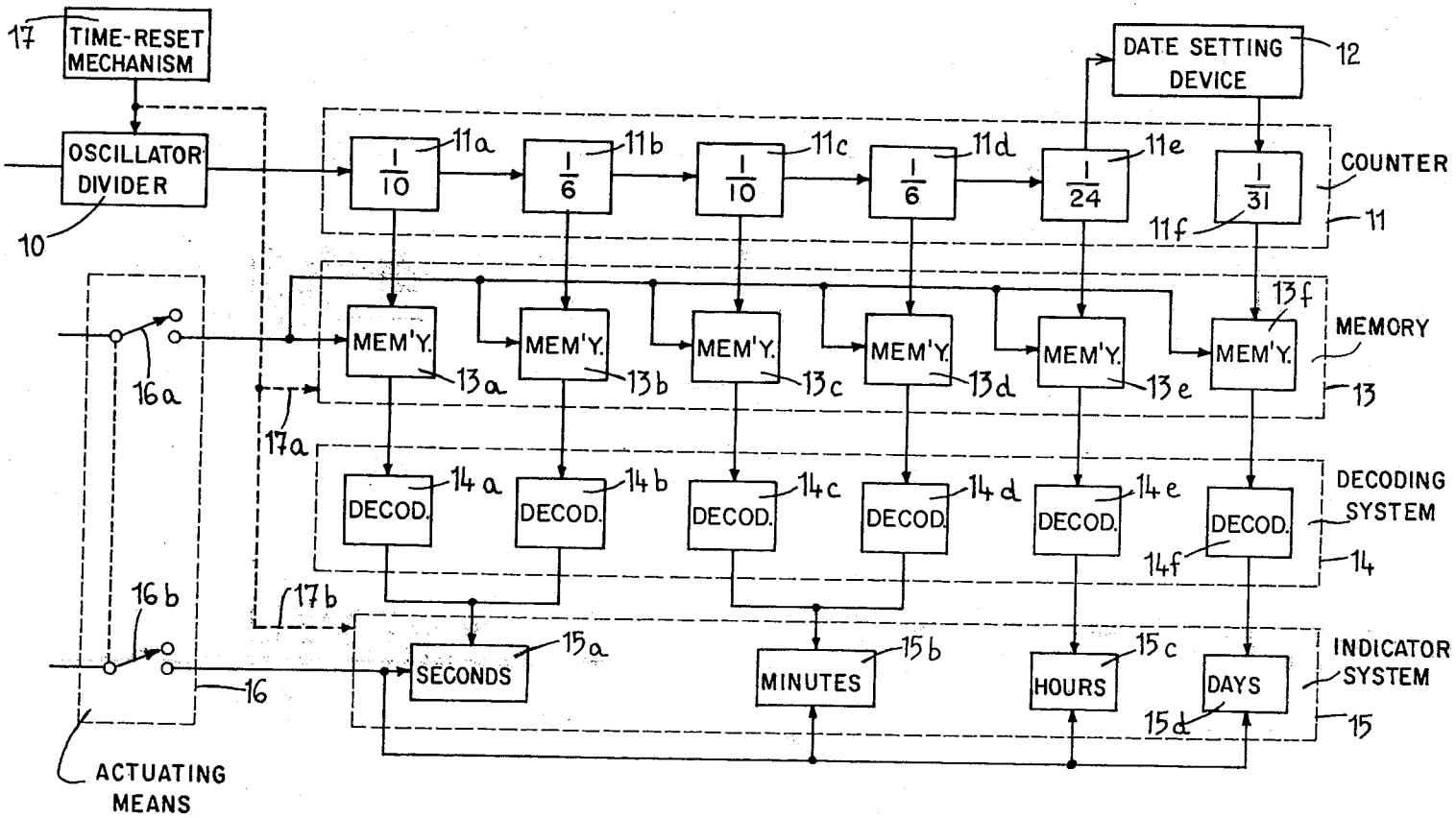
FIG. 2 is a schematic diagram, indicating the principle components of the apparatus of FIG. 1.
Figure 2A:
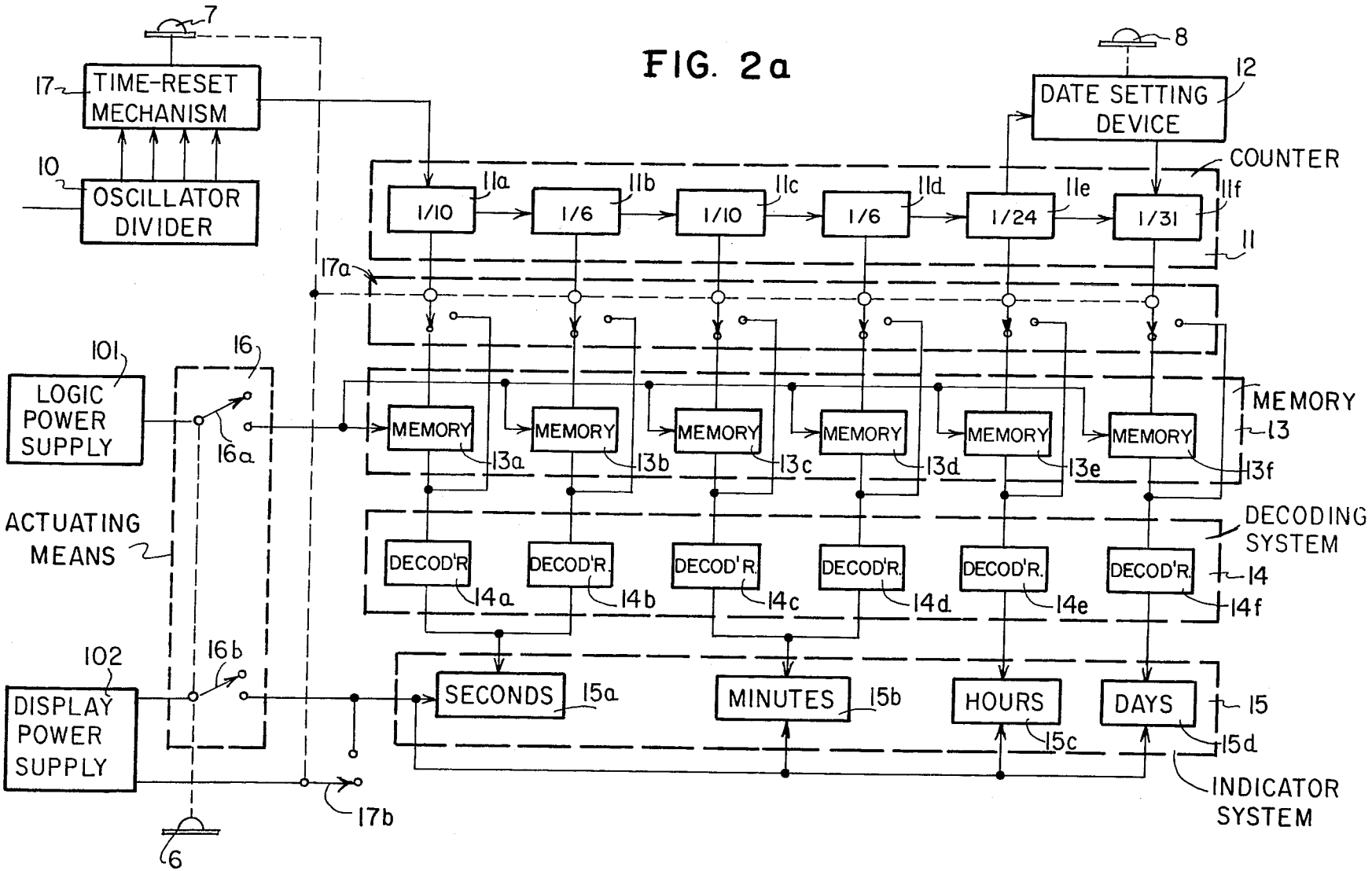
FIG. 2*a* is a diagram similar to that of FIG. 2 including operative components.

The apparatus of FIGS. 1 and 2 comprises a casing provided with a rim 1: it comprises also a dial 2 with windows 3, 4 and 5 for showing the time, the day and the month respectively.

The apparatus also comprises a throwing button 6, the operation of which will be described hereinafter, which controls the showing of the time and the date of occurrence of a given event, and buttons 7, 8 and 9 for resetting the apparatus with respect to time, day and month, respectively.

The apparatus further comprises an oscillator and frequency divider 10, of conventional type, controlled by means of a crystal, e.g. a quartz crystal, composed of a series of bistable frequency dividing multivibrators, the lowest operative frequency output of which is a square wave of predetermined frequency, e.g. 1 Hz, and the frequency stability of which is a function of the stability of the control oscillator. With such common oscillators, it is possible to keep relative variations as low as $10^{-5}$ to $10^{-7}$. Other outputs of the oscillator comprise zero frequency and frequencies higher than one, e.g. 10 and 2 according to usual practice.

The oscillator-divider 10 is connected through a time reset circuit 17, in turn, to a series of frequency dividers 11*a*, 11*b*, 11*c*, 11*d*, 11*e* and 11*f*, which constitute together with the oscillator a time-counter 11. Divider 11*a* is a divider of frequency by ten which comprises, for instance, a series of four bi-stable multivibrators, and which counts the seconds ($f = 1$ Hz), up to ten in the present Example. Divider 11*b* divides by six and counts the tens of seconds, and so forth. The remaining dividers 11*c*, 11*d*, 11*e* and 11*f* count the minutes, the tens of minutes, the hours up to 24 and the days up to 31, respectively. A date reset device 12 controlled by button 8 is connected between dividers 11and 11*f*.

It should be noted that the oscillator-divider 10 could furnish, if desired, a lowest signal having a frequency different from 1 Hz. This frequency could be, for instance, 10 Hz, the counter being then provided with an additional divider for dividing by ten, connected before divider 11*a*, for counting the tenths of seconds.

It should be further noted that the sequence of dividers 11*a* to 11*f* could be supplemented by other dividers for indicating the months and the years, for example.

Each of the dividers 11*a* to 11*f* which, together with the oscillator, constitute the counter 11 is connected to one memory element 13*a* to 13*f*, respectively, which on the whole constitutes a memory 13, then to a decoding circuit 14 made of elements 14*a* to 14*f*, and, finally, to an indicator system 15 which comprises indicators 15*a*, 15*b*, 15*c* and 15*d* for showing the seconds, the minutes, the hours and the days, respectively.

Actuating means 16, constituted by switches 16*a* and 16*b* controlled by button 6, operate on the elements 13*a* to 13*f* for activating the memory and, simultaneously, for turning on the indicating system 15 so that the indications transmitted become visible.

The apparatus further comprises a time-reset mechanism 17 actuated by button 7 which operates simultaneously on the counter 11, the memory 13 and the indicator 15. It should be noted that the memory elements can be magnetic elements (ferrite), static elements (bi-stable multivibrators) or other conventional memory elements. The decoding elements can be made of gates, e.g. NAND gates, according to usual circuit construction. The indicating system can have electroluminescent diodes using gallium arsenide or phosphide, or luminous liquid crystals or other electric indicating means.

When it is desired to record the time of a given event, the counter of the present apparatus being first synchronized with a given standard time but no reading being yet visible on the indicator, means 16 are actuated by depressing button 6 at the moment the event occurs. Switch 16*a*, when closed, sends a signal, a logical one for instance from a logic power supply 101 to elements 13*a* to 13*f*, as shown on FIG. 2. Memory 13 is activated by said signal and instantaneously records the state of the counter as it is at the moment means 16 are being actuated. Simultaneously, the indicator 15 being turned on by switch 16*b* connected to a power supply such as a display power supply 102, the reading becomes visible and indicates the time recorded by the Memory 13 through the signals coming from said memory and decoded by circuit 14. When a note has been made from the reading, a second depressing of button 6 resets switches 16*a* and 16*b* back to zero; this erases the readings on the indicator and deactivates the memory 13.

As a modification, means 16 could be driven electrically, for instance because of the existence of an incoming signal from a photo-cell or from any other relay system. With such an arrangement, it would be possible to measure, for instance, the time when a moving object passes by a given point, said object preventing, in that position, a light ray from reaching said photo-cell, or otherwise, the time of occurrence of a phenomenon which can release said relay.

When the present apparatus should be reset, the resetting device 17, which is started by depressing button 7, works on the oscillator-divider 10 for having the latter deliver a signal of frequency initially equal to normal frequency, then zero and finally higher than the normal frequency at the output of the oscillator; this result being a direct consequence of the amount of pressure on button 7 which operates on a series of switches, (not shown) but part of 17, that control the various output stages indicated by the arrows between 10 and 17 of the oscillator. At the same time, by means of other series of switches 17*a* and 17*b* coupled together also controlled by button 7, memory 13 is shorted and the indicator 15 is being made visible so that the pulses of the counter 10 at the output of 17 are continuously applied, after decoding, to the indicator and can be read continuously. Hence, to a strong pressure on button 7 corresponds to a fast running of the counter which can be visualized on the indicator. Thus, the counter is set slightly fast relatively to the real time, then it is stopped by releasing slightly button 7; finally, at the very moment the time reading coincides with the standard time, button 7 is released completely and the clock-work resumes its running in perfect synchronism with the standard time.

It should be noted that the date setting device 12 operates similarly, by means of button 8, however it only operates on the day readings without interfering with the running of the counter with regard to seconds, minutes and hours.

It should be further noted that button 9 of the present apparatus operates mechanically on the reading of the month, which is permanently visible on window 5, independently of the time-keeping mechanism of the apparatus. As mentioned before, it is understood that, if desired, month changes or even year changes could be carried out electrically and indicated automatically on the dial when required. In such a case, the circuit would be identical to that of FIG. 2 except for the total number of blocks comprised by counter 11, memory 13, decoding system 14, and display 15. For instance, each of said elements would comprise two additional blocks labelled g and h (not shown) concerned with the months and the years respectively i.e., on the right side of the diagram, blocks 11*g*, 11*h*, 13*g*, 13*h*, 14*g*, 14*h*, 15*g*, 15*h* would be added.

Figure 3:
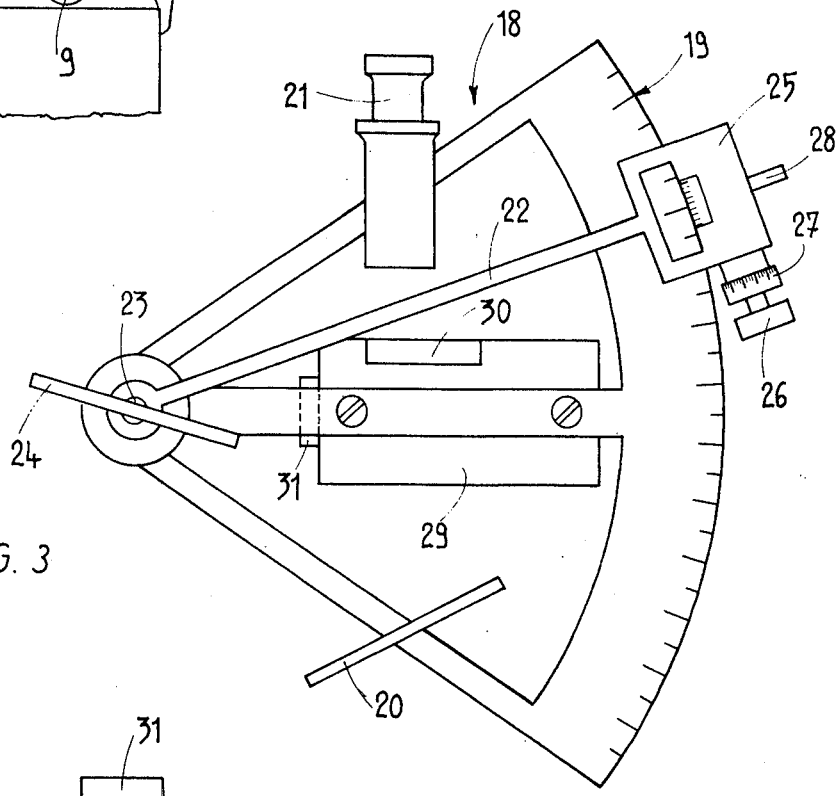
FIG. 3 illustrates schematically another embodiment of the apparatus in the form of a sextant.

FIG. 3 represents another embodiment of the apparatus in the form of a sextant. This sextant comprises a limb 18 with a calibration 19, a small mirror 20, a glass 21 and an alidade 22. The latter, hinged in 23 on the limb 18, carries a large mirror 24 which can be moved and a vernier 25 which can be finely set by means of a drum 26 and a micrometer screw 27; the latter can be engaged by means of control 28.

Figure 4:
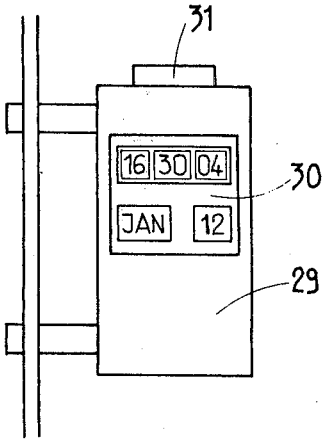
FIG. 4 is a front view of a detail of said sextant.

The apparatus also comprises a handle 29 provided with a window 30 for indicating the time, as seen in FIG. 4, and a control button 31. The time mechanism of the apparatus, which is similar to that of the wristwatch of FIG. 2, is housed in the inside of said handle.

The release of the time readings on window 30 is carried out as in the case of the apparatus of FIGS. 1 and 2 by depressing button 31. The latter has two functions and is also used. when turned in one way or the other, for resetting time. For instance, exciting axial fringe pressure on button 31 operates switches having identical functions to switches 16*a* and 16*b* described above which results in having the depressing time appear on window 30. On the other hand, applying a clock-wise rotation to knob 31 produces a faster running of the counter exactly as did a high pressure on button 7 described above, while an anti-clockwise rotation of knob 31 results in stopping the counter as did a mild pressure on button 7. Handle 30 also carries the control devices (not shown) to reset the date and the month.

The present apparatus is used as follows: when a sailor wants to determine the position of his ship, he must have the reference star and the horizon coincide by looking through the glass and properly adjusting the alidade and simultaneously he must record the GM time when the correct setting is obtained.

This aim can be easily reached with the present apparatus by pushing button 31 at the moment when the sun is in the right position. Thereafter, it is possible to remove the eye from the glass and write, without haste, the angular and time indications given by the instrument. With the present apparatus it is therefore possible to determine the position of a sailing ship much more simply and accurately than with usual sextants.

Figure 5:
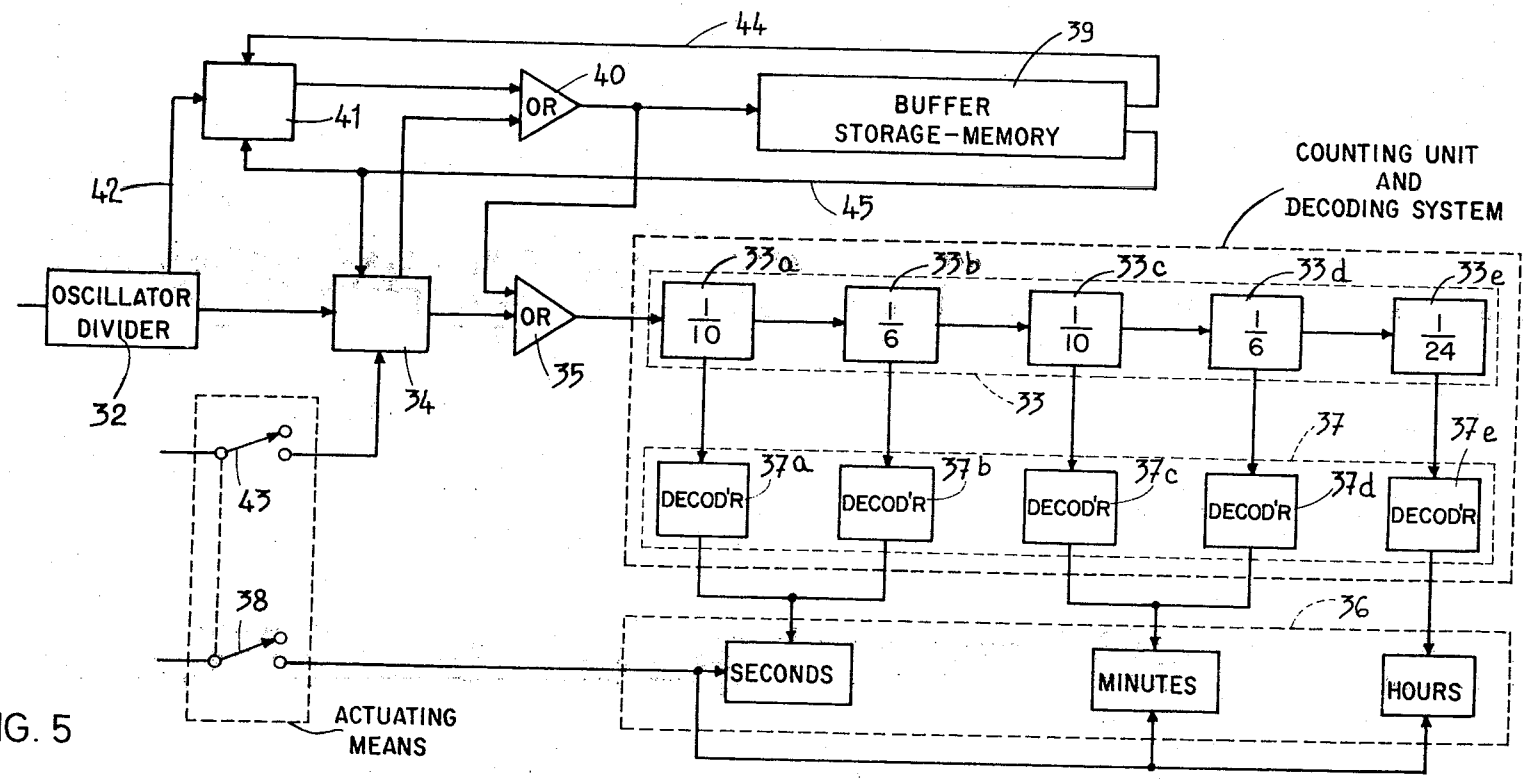
FIG. 5 is a diagram, similar to that of FIG. 2, of a modification of the invention.

For the sake of clarity, some of the peripheral devices of the modification shown in FIG. 5, e.g. the time-resetting and date indicator, have been omitted.

The apparatus represented in FIG. 5 comprises an oscillator-divider 32 connected to the input of a counting unit 33 the time resetting circuit being omitted. This unit comprises, in succession, the elements 33*a* to 33*e* which count the hours, the minutes and the seconds, respectively. The elements 32 and 33 constitute the so-called time-counter. A commutating circuit 34 and a gate 35 are connected between the oscillator-divider and the counting unit 33. Normally, circuit 34 and gate 35 are conducting and allow the pulses of frequency 1 to pass freely from the oscillator 32 to the counting unit 33. Hence, said pulses accumulate in the counter and their sum is permanently sent to the indicator 36 of the apparatus through the decoding unit 37 which comprises the decoding elements 37*a* to 37*e*. The indicator is controlled by a switch 38. Normally, this switch is open which permits saving a large amount of energy.

The present apparatus also comprises a buffer storage memory 39 connected to circuit 34 through a gate 40 and a circuit 41, for discharging the memory, connected by a line 42 to the output of one of the dividing circuits of the oscillator-divider 32. The frequency of the pulses available at this stage is, digitally speaking, larger than the total of the pulses which can be stored in the memory 39. In the present case, if the memory comprises seven flip-flops, the total of the storable pulses, using the binary system, will be 128; hence, it will be advantageous, as will be seen later, to connect the discharge circuit 41 to the 1000 Hz output of the oscillator-divider.

The operation as evident from FIGS. 5 and 10–13 is the following: When the switch 43 which controls circuit 34 is closed by means of an external driving control, e.g. by pushing button 6 and establishing a connection between circuit 34 and a logical power supply 113 having a blocking output, then circuit 34 is deactivated and instantaneously stops counter 33 from counting and the digital state of the latter at the moment it was blocked is shown on the indicator 36 and is made visible by closing switch 38 connected to a display power supply 114. It should be noted that switches 38 and 43 can be coupled or not. Simultaneously, the pulses generated by the oscillator-divider 32 are by-passed to gate 40 and then to the storage memory 39 wherein they accumulate. The capacity of said memory is limited, in the present case, to 128 pulses of frequency 1, that is 128 sec., which is quite enough for writing the indication of time appearing on indicator 36, then turning off the indicator light by switching off switch 38–43. When the memory is saturated, the last recorded pulse triggers, by means of line 44, the circuit 41 for discharging the memory 39. This memory discharges as follows: when circuit 41 is activated, the memory flip-flops are put back to 0, one after the other, upon reception of the 1000 Hz pulses coming from the intermediate stage of the oscillator through circuit 41 and gate 40. Simultaneously, said pulses are sent to the counter 33 through gate 35 for resetting it to standard condition. In the present case, the discharge time is 128 msec, since each discharge pulse from the oscillator is lmsec which is hardly larger than a tenth of the time between two consecutive counting pulses. Hence, it is impossible to have the normal counting pulses interfere with the discharge and resetting pulses. When the last one of the memory flip-flops comes back to zero, a signal transmitted on line 45 reactivates circuits 34 for having the counter, which has now been reset, resume its normal operation.

It should be noted that, in place of or in addition to line 44, the apparatus could be provided with an external control for discharging the memory and resetting the counter, if desired, before said memory is completely filled.

It should also be noted that standard circuit elements can be used for making the present apparatus. For instance, it would be advantageous to use integrated circuits which would combine some of the circuits described above, e.g. circuits 33 and 37 or, better, circuits 33, 36 and 37.

An example of such circuit is the commercial type CD4017A made by RCA. It should be further noted that the latter could be replaced by mechanical elements, see FIG. 11, for example regular hands 125 driven by a motor 126 and gears operating stepwise by means of the pulses supplied by the oscillator 32 and amplified in the amplifier 127 and acting on the magnet 129 and the ratchet 128. However, in such a case, it will be necessary to take care that the transmission of the resetting pulses takes place in the absence of the counting pulses. In other words, if the stepwise operating motor, even at maximum speed, cannot provide a sufficiently large number of resetting steps between two counting pulses, for instance if the resetting frequency on line 42 is, say, only 4Hz, it will be necessary to insert an additional circuit between the output of the oscillator-divider 32 and circuit 41, for adding to the memory, during the discharge period, the counting pulses which are produced during said discharge. This can be easily done by means of an inverter 130 which will simply outphase the counting and resetting pulses, the driving edge of each pulse being determinant so that they do not interfere with each other.

Figure 12:
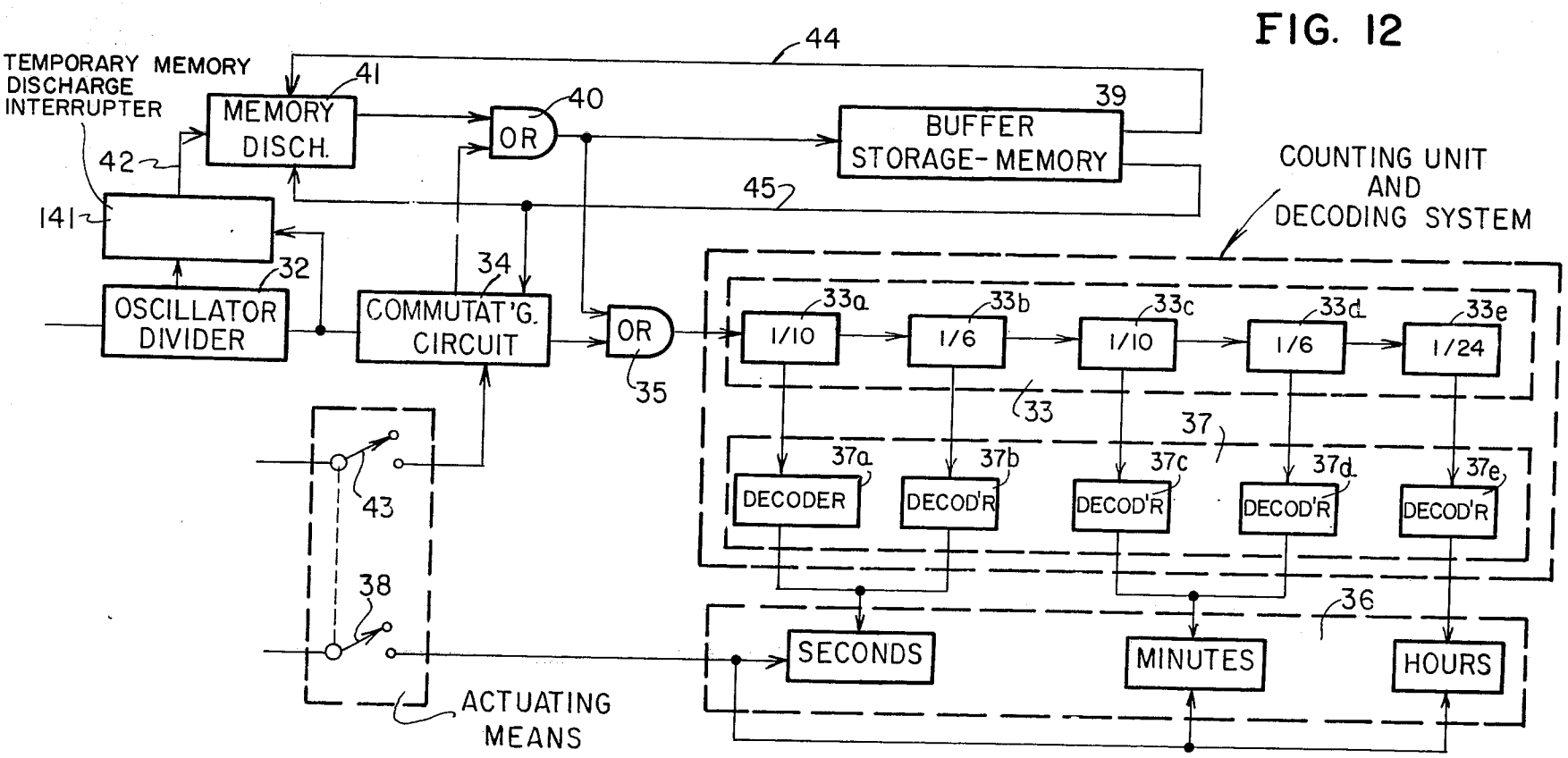
Figure 13:
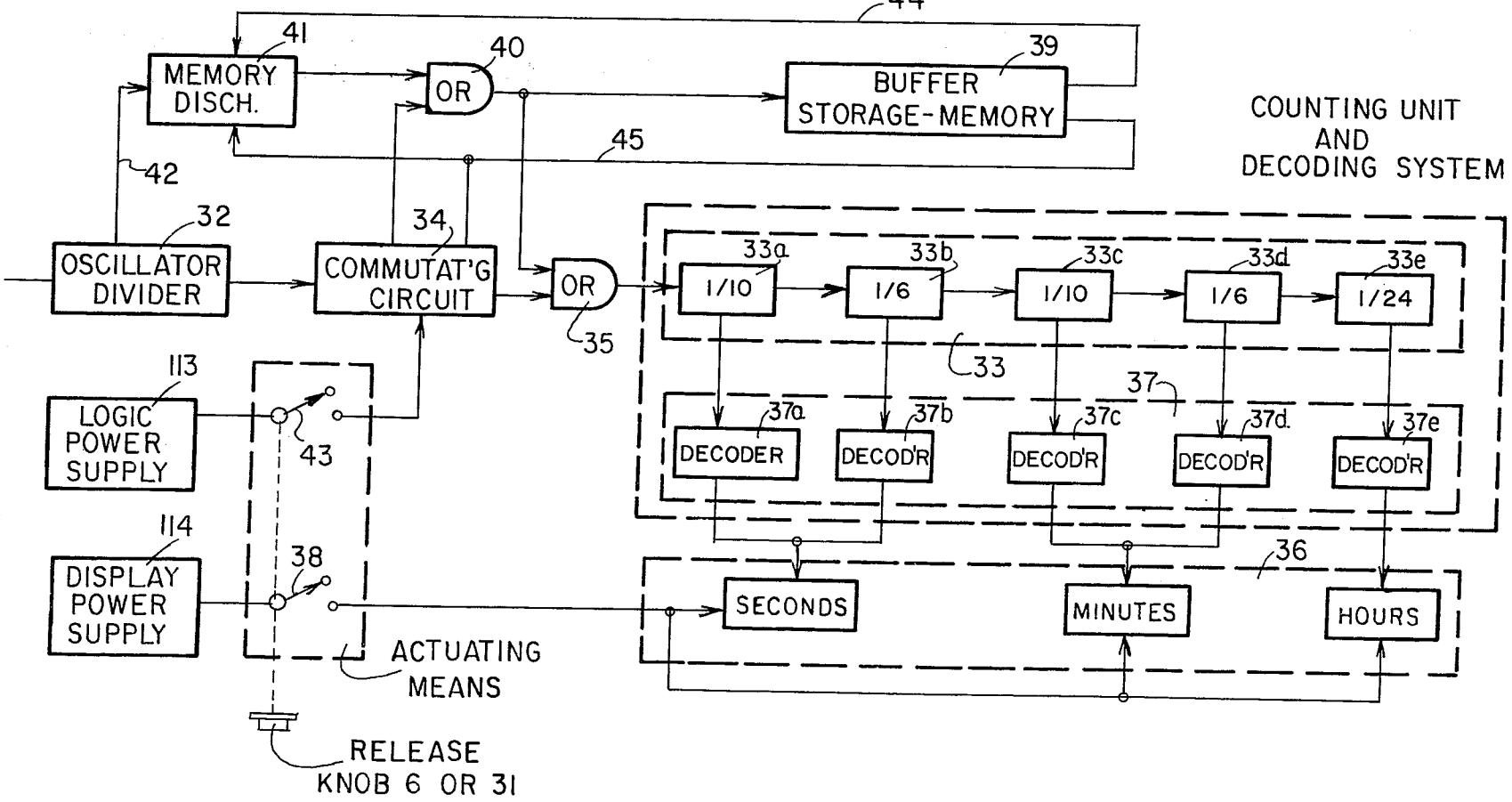

It would also be possible, if desired, to insert a circuit 141, see FIG. 12, for interrupting temporarily the discharge of the memory upon arrival of a counting pulse.

Figure 6:
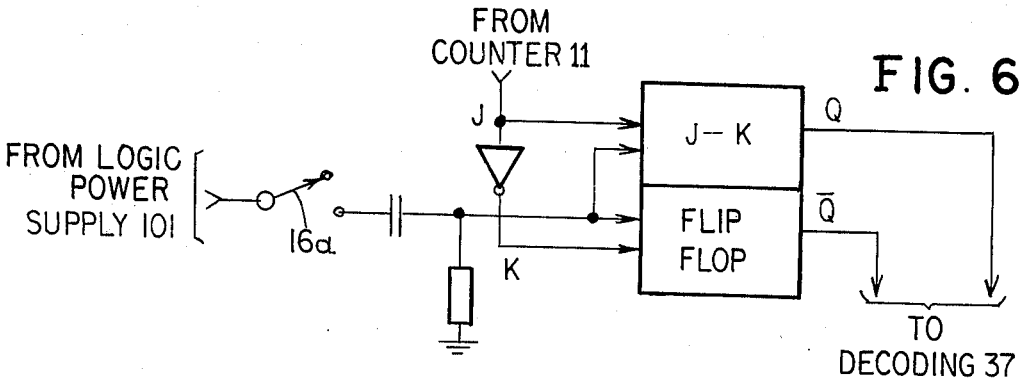
FIG. 6 illustrates a memory element.
Figure 7:
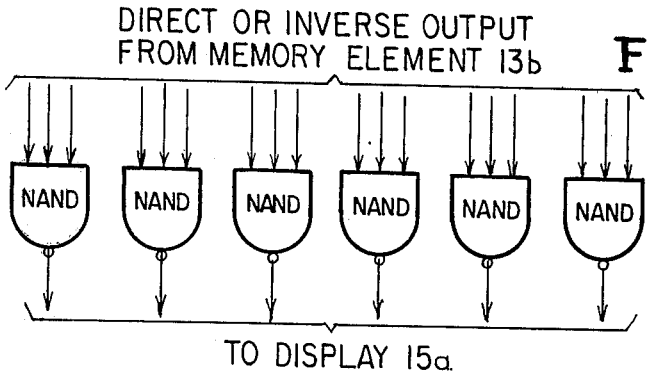
FIG. 7 illustrates a decoding element.
Figure 8:
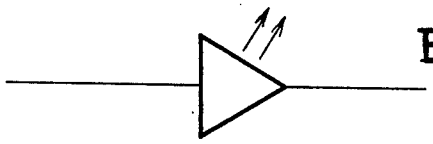
FIG. 8 shows schematically an indicating element.
Figure 9:
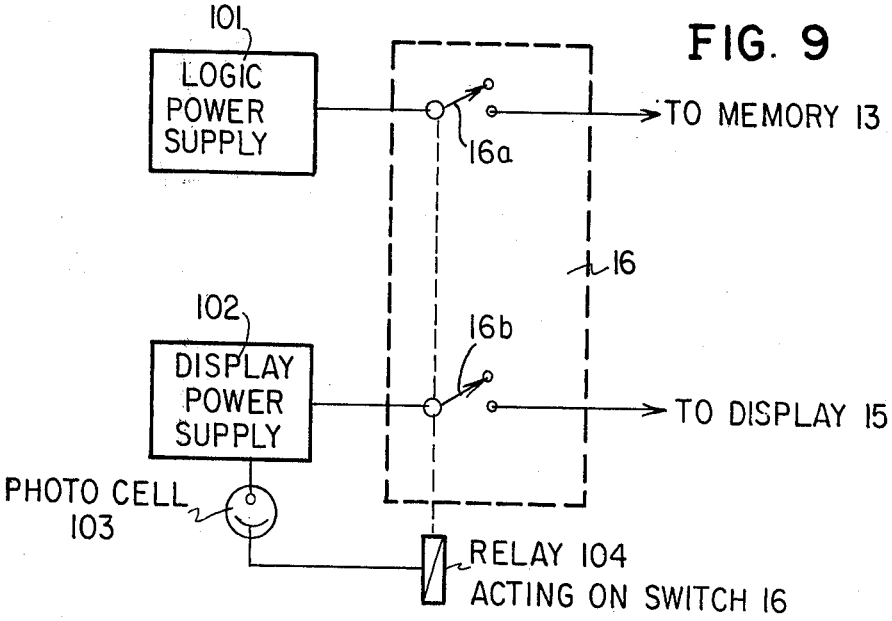
FIG. 9 illustrates a photocell assembly.
Figure 10:
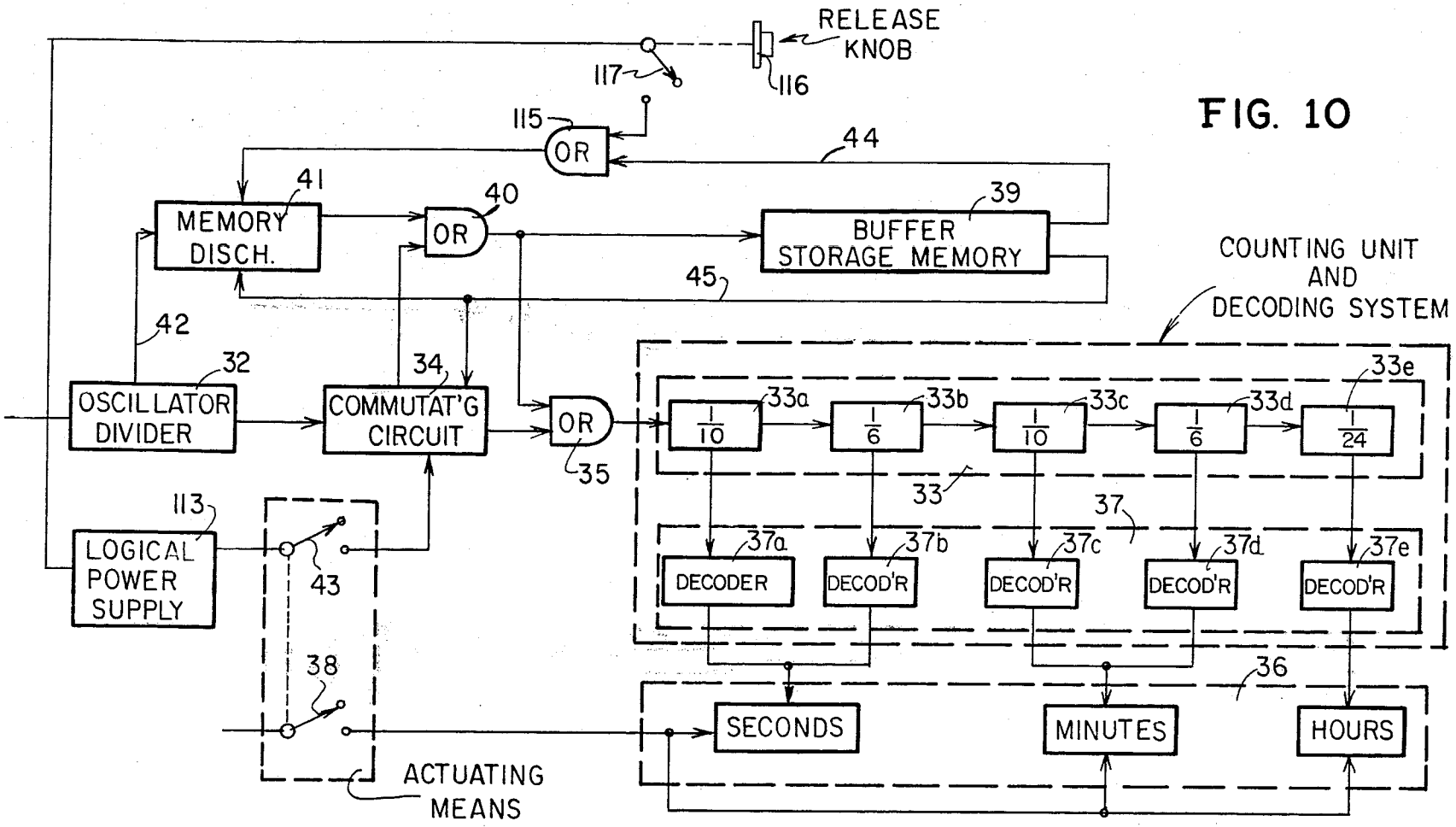
FIGS. 10–13 illustrate further embodiments of FIG. 5.
Figure 11:
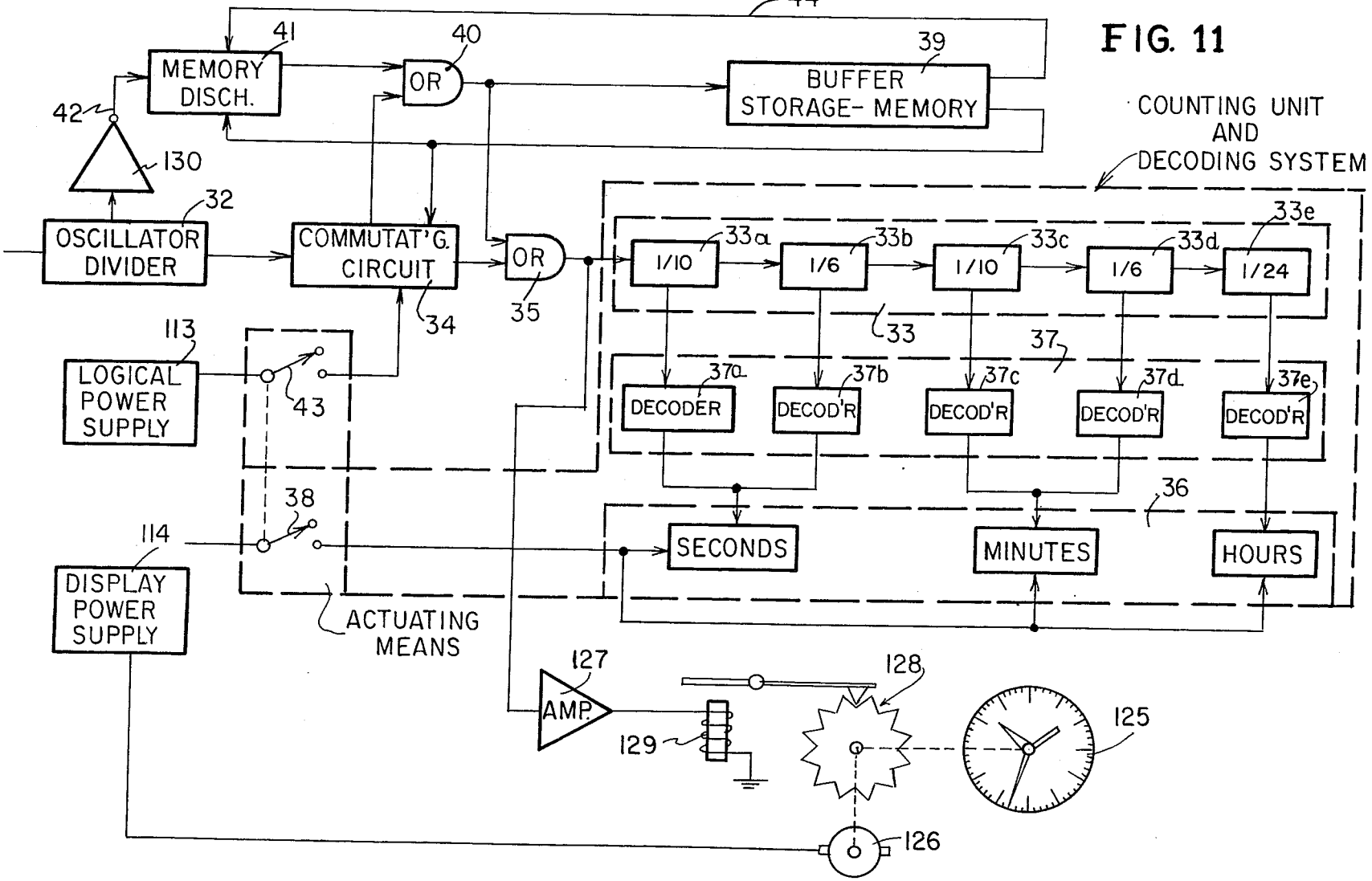

In FIGS. 6 to 9, further details of elements and connections are shown. For instance, the circuit in FIG. 6 is constructed such that when a logical signal is passed by switch 16*a*, this activates the memory element for recording the state of the corresponding element of the counter.

It is evident that the present apparatus could have forms different from those described hereinabove. Thus, it could be included in a radio or TV receiver, in a camera, or it could be part of the panel-board of a motor-vehicle, etc.; it would then be possible to automatically record some desired time information relative to the operation of said appliances.

It is believed that the foregoing adequately will enable those skilled in the art to appreciate and practice this invention and, if necessary, make modifications which will fall within the scope of the invention as defined by the accompanying claims.

What it is desired to secure by Letters Patent of the United States is:

1. Apparatus for determining and temporarily recording the time an event occurs, comprising:

A. a time counter,

B. a memory,

C. a time indicator, the time counter being coupled to the memory and the time indicator D. means for providing an active connection between a. the counter and the memory, and b. the counter and the time indicator, wherein the connection is arranged such that when the means for providing said connection with the memory is actuated, the time indicator indicates the time when said connection has become effective wherein the memory is a storage memory, the connecting means between said memory and said counter being arranged such that when said connecting means becomes operative the counter is temporarily blocked, the counting pulses are by-passed to and collected by the memory and, when the latter is fully loaded, the same number of pulses which are stored in the memory but having a frequency higher than that of the counting pulses are sent to the counter for time resetting purposes.

2. The apparatus as set forth in claim 1, in which the time-counter produces digital conditions and comprises a series of dividers for counting seconds, tens of seconds, minutes, tens of minutes, hours and days, respectively.

3. The apparatus as set forth in claim 1, comprising a quartz crystal-oscillator.

4. The apparatus as set forth in claim 1, in which the connecting means to the indicator comprises a decoding unit.

5. The apparatus as set forth in claim 1, in which the means for providing the connection between the counter and the memory for actuating the memory is constructed to simultaneously actuate the indicator.

6. The apparatus as set forth in claim 2, means wherein during said resetting there is a speeding up of the running of the counter and simultaneously the digital condition of said counter is continuously visible on the indicator.

7. The apparatus as set forth in claim 2, wherein during the connection of said memory and said counter, there is a complete means stopping of the running of the counter and simultaneously the digital condition of said counter become continuously visible on the indicator.

8. The apparatus as set forth in claim 1, being constructed as a wrist-watch.

9. The apparatus as set forth in claim 1, further comprising a housing constructed as a nautical sextant the handle thereof carrying the indicator dials and a depressing button for controlling the operation of the apparatus, including the connecting means, resetting and indicator devices.

* * * * *

UNITED STATES PATENT AND TRADEMARK OFFICE

CERTIFICATE OF CORRECTION

PATENT NO. : 3,962,861

DATED : June 15, 1976

INVENTOR(S) : Jean-Claude Protta et al

It is certified that error appears in the above-identified patent and that said Letters Patent are hereby corrected as shown below:

Column 2, Line 59, change "11and" to -- 11e and --.

Column 8, line 10, omit "means".

Column 8, line 17, omit "means"

Signed and Sealed this

First Day of February 1977

[SEAL]

*Attest:*

RUTH C. MASON
*Attesting Officer*

C. MARSHALL DANN
*Commissioner of Patents and Trademarks*